United States Patent [19]

Harris et al.

[11] 4,155,131

[45] May 22, 1979

[54] PLATFORM BED FRAME

[75] Inventors: Allan E. Harris; George M. Harris, both of Chicago, Ill.

[73] Assignee: Harris-Hub Co., Inc., Harvey, Ill.

[21] Appl. No.: 920,340

[22] Filed: Jun. 29, 1978

Related U.S. Application Data

[63] Continuation of Ser. No. 853,553, Nov. 21, 1977, abandoned.

[51] Int. Cl.[2] ..... A47C 19/00; A47B 47/00

[52] U.S. Cl. ..... 5/296; 5/201; 5/207; 5/288; 312/257 SK; 312/263

[58] Field of Search ..... 5/200 R, 201, 207, 288, 5/294–301, 140; 312/257 R, 263

[56] References Cited

U.S. PATENT DOCUMENTS

| | | | |
|---|---|---|---|
| 1,735,307 | 11/1929 | Weston | 5/294 |
| 3,501,786 | 3/1970 | Hurritg | 5/207 |
| 3,606,028 | 9/1971 | Klein | 5/288 |
| 3,793,655 | 2/1974 | Harris et al. | 5/296 |

*Primary Examiner*—Casmir A. Nunberg

[57] ABSTRACT

A platform bed frame for a platform bed is provided which is capable of supporting a conventional mattress and box spring combination, or a mattress alone. The platform bed frame includes side plates and end plates which are connected together by coupling members which in preferred embodiments may be interlocked without using screws and bolts to form a rectangular platform bed frame. In preferred embodiments the coupling members are integral with the end plates and side plates so that they cannot be lost during shipment.

30 Claims, 15 Drawing Figures

PLATFORM BED FRAME

This is a continuation of application Ser. No. 853,553, filed Nov. 21, 1977, now abandoned.

BACKGROUND OF THE INVENTION

This invention relates to platform bed frames for platform beds, and specifically to connecting members for securing the side plates and end plates of a platform for a platform bed together.

For a number of years, platform beds, which consist of a mattress sitting on a platform, have been widely used in Europe but have not been widely accepted in the more affluent United States. A major reason for the popularity of these beds in Europe is that living quarters generally have much less space than is the case in the United States, and platform beds are more space-efficient than the conventional Hollywood-type beds which have almost totally dominated the domestic market. Recently, there has been an upsurge of interest in this country in platform beds, and this new founded popularity is generally attributed to apartment dwellers who must make more efficient use of space than home owners. In addition, platform beds blend well with modern furniture, and especially well with modular furniture that is popular in many apartment dwellings because it maximizes the use of floor space. Also, platform beds have a number of other advantages over the conventional Hollywood beds. For example, the exposed legs of conventional Hollywood bed frames are a major cause of many household accidents, notably stubbed toes, and the like. Platform beds do not have exposed legs, and thus are not as likely to cause such accidents. And, because a platform bed does not have legs and sits on the floor, it totally encloses the floor space upon which it rests, and thus obviates the need to dust or vacuum underneath the bed.

The platform bed frame or platform of a platform bed, generally includes two side plates or panels, which are joined to transversely disposed end plates by conventional coupling members, such as screws and bolts, and the like. One problem with joining platform bed frames in this manner is that in some cases the screws and bolts are visible on the outer portion of the platform and detract from its appearance. Another problem is that screws and bolts are easily lost during shipment. Thus, it is desirable to fabricate side plates and end plates which have coupling members in a form which is not easily lost, and which are preferably secured on the side plates and end plates so that they may be shipped without any loose parts and in a condition whereby a consumer can merely snap or slide the side plates and end plates together in a matter of minutes to form the platform bed.

Another problem with most prior art platform bed frames for platform beds, is that they have been usually designed to support only a mattress, and not the conventional box spring and mattress combination which is used on a Hollywood bed frame. When a conventional mattress is used on a platform bed frame, it is not as comfortable as the mattress/box spring combination used on a Hollywood bed frame, because the box spring provides an extra amount of cushioning that increases the comfort of the conventional mattress. To overcome this problem, specially made mattresses have been designed for use on platform bed frames. However, these specially designed mattresses are not as readily available as conventional mattresses, and are generally more expensive. Moreover, potential users of platform beds may desire to use a mattress which they already own, and may be unwilling to spend extra money to purchase a specially-made mattress. Consequently, price and comfort considerations may deter some potential purchasers from buying platform beds. Thus, the availability of a platform bed frame which could support the conventional box spring and mattress combination, could alleviate this problem, and provide more people with a viable option of using platform beds with their consequent safety and utility advantages.

SUMMARY OF THE INVENTION

In accordance with the present invention, a platform bed frame for a platform bed is provided which is capable of supporting a conventional mattress and box spring combination, or a conventional mattress alone. Preferably the side plates and end plates are metal which may be provided with connecting or coupling members which may be interlocked without using screws and bolts, and which in a preferred embodiment are integral with the end plates and side plates so that they cannot be lost during shipment.

More specifically, the platform bed frame comprises a pair of spaced parallel side plates having substantially identical dimensions. Each side plate includes a wall portion, a support portion, and a foot portion. The wall portion defines an upper edge and a lower edge and is disposed in relation to the floor to provide upright support for a mattress and/or box spring. The support portion of each side plate is integral with the upper edge of the wall portion and provides horizontal support for the frame portion of a box spring so that the box spring may be disposed directly on the platform bed frame, or for conventional slats which may be disposed crosswise between the side plates to support either a conventional mattress or a mattress and box spring. The foot portion is integral with the lower edge of the wall portion and serves to confront the floor or surface upon which the platform is situated. The end plates are longitudinally spaced with respect to the side plates and extend perpendicularly between them so that the end plates and side plates define a substantially rectangular platform bed frame. Each end plate has substantially the same dimensions and includes an intermediate portion, an upper arm portion, and a lower leg portion. The intermediate portion defines an upper edge and a lower edge and is disposed in relation to the floor to provide upright support for the mattress and/or box spring. An upper arm portion is integral with the upper edge of the intermediate portion and provides support for a portion of the mattress and/or box spring. A lower leg portion extends from the lower edge of the intermediate portion and confronts the floor upon which the platform is situated. Connecting members for detachably securing each of the end plates to the side plates to form a generally rectangular platform are also provided.

In one preferred embodiment, the connecting or coupling members comprise a generally planar central body portion having a male member extending upwardly from an upper edge of the body portion, and a female member for slidably receiving the male member of an adjacently disposed coupling member. More specifically, the male member extends generally upwardly of the upper edge of the central body portion and is tapered so that its outer end has a narrower width than its inner end. The female portion of the coupling member is integral with the central body portion and is disposed adjacent a side edge of the body portion in a substantially L-shaped arrangement therewith. The lower end of the female portion is substantially coextensive with the lower end of the central body portion, and the female portion is tapered so that its width is smaller at its lower end than its upper end. The female portion includes an inner section having a shape corresponding to the shape of the male portion, and an intermediate section extending substantially inwardly of and transversely to the inner section, and an outer flange section extending generally inwardly of the intermediate section and toward the central body portion so that the female portion may slidingly interlock with the male portion of an adjacent coupling member. The coupling members are secured to the wall portions of the side plates and the intermediate portions of the end plates near each end thereof with the coupling members secured to each of said end plates inversely oriented with respect to the coupling members secured to each of the side plates so that the male portion of each of the coupling members is disposed in the female portion of each adjacent coupling member to thereby form a substantially L-shaped joint whereby the side plates and end plates are mounted relatively rigidly in interlocking relationship with one another by forces applied to the side plates and end plates by the mattress and/or box spring and the floor.

DETAILED DESCRIPTION OF THE DRAWINGS

DETAILED DESCRIPTION

Figure 1:
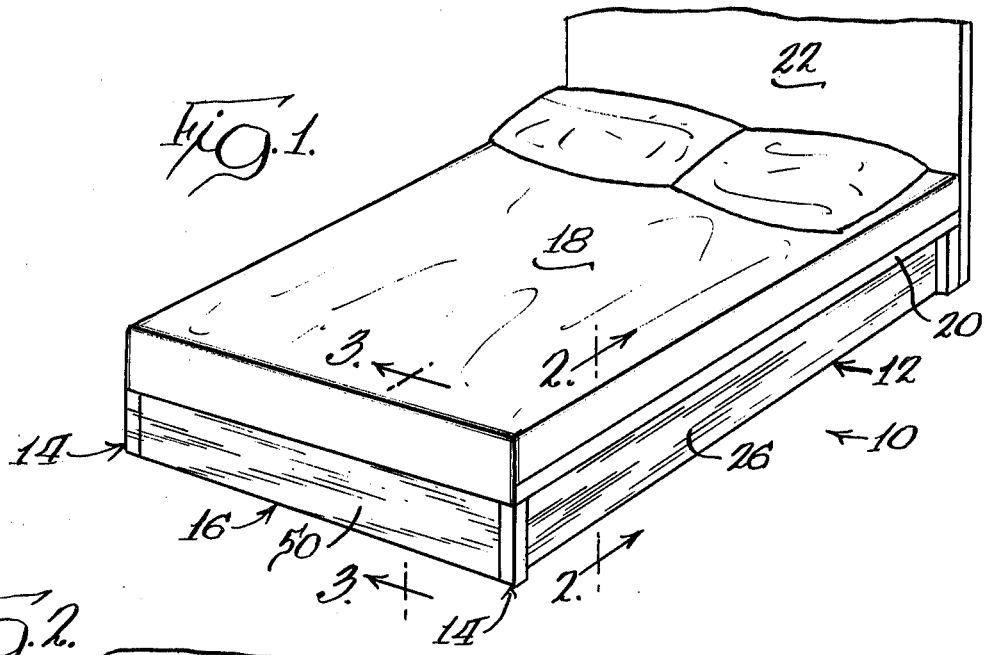
FIG. 1 is a perspective view of a platform bed having a platform in accordance with the present invention.

While this invention is susceptible of embodiment in many different forms, there is shown in the drawings and herein will be described in detail several preferred embodiments of the invention and modifications thereof, with the understanding that the present disclosure is to be considered as an exemplification of the principals of the invention and is not intended to limit the invention to the embodiments illustrated. The scope of the invention will be pointed out in the appended claims.

Referring now to the drawings, FIG. 1 shows a first embodiment of a platform bed frame of the present invention. For purposes of convenience, the platform bed frame is hereinafter referred to as a platform. The platform 10 includes side plates 12, only one being shown, which are in spaced relationship with one another and are interconnected through joints 14 by end plates 16 which extend perpendicularly between the side plates to form a generally rectangular platform. A mattress 18 is suitably disposed on the platform 10, and is prevented from moving transversely with respect to the side plates by means of flanges 20 which extend upwardly from the side plates 12 on both sides of the platform. The transverse distance between the flanges 20 is slightly greater than the width of the mattress 18 which is to be disposed on the platform 10 so that the mattress may be securely placed on the platform. As is shown in the illustration, the platform may suitably be provided with headboard 22 which is secured to the platform by headboard bracket 24 (see FIG. 7), which are discussed in more detail below.

Figure 2:
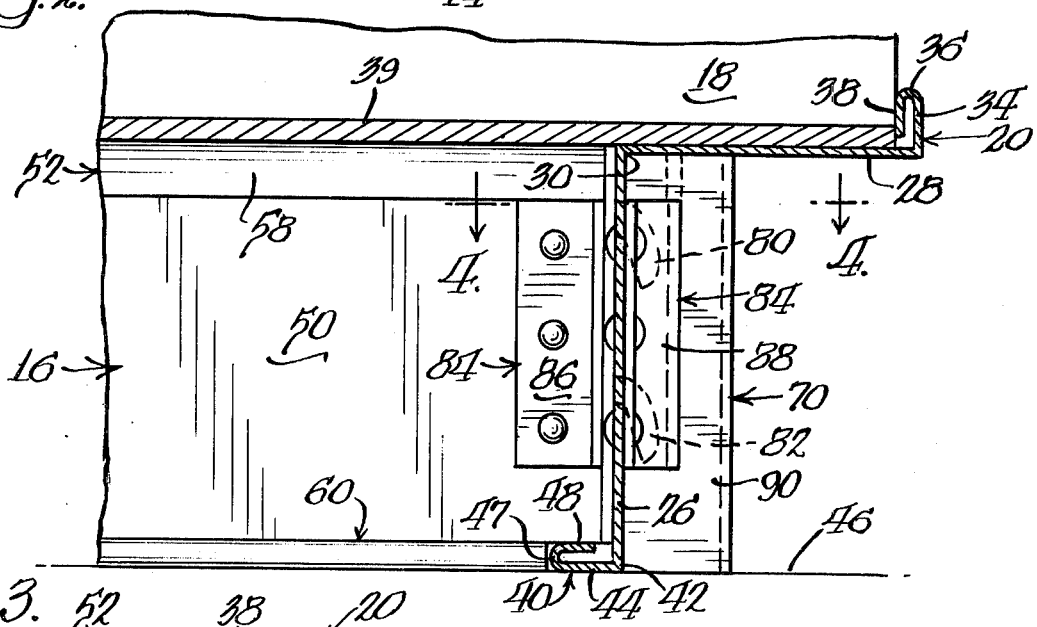
FIG. 2 is an enlarged fragmentary cross-sectional view taken along line 2—2 of FIG. 1 showing an embodiment of a coupling member of the present invention.

The side plates 12 of the platform have a unique configuration, best illustrated in FIG. 2, which enables the platform bed base to support not only the mattress, but also a box spring and mattress combination as is ordinarily used on a Hollywood bed frame. Side plate 12 includes a wall portion 26 which is disposed in relation to the floor to provide upright support for the mattress and/or box spring. Preferably, as is shown in FIG. 2, wall portion 26 is substantially planar and has a generally rectangular shape so that the mattress may be supported at a uniform height from the floor. Support portion 28 extends from the top edge 30 of wall portion 26 in a direction which is generally transverse of wall portion 26 and generally parallel to the floor. A flange member 20 is integral with the outer edge of support member 28. Flange member 20 includes a generally planar portion 34 which extends upwardly from the support member 28 to an arcuate portion 36 which extends inwardly of planar portion 34 to a terminal portion 38 which extends downwardly from the arcuate portion 36.

A foot portion 40 is integral with the lower edge 42 of wall portion 26, and serves to confront the surface upon which the platform bed base 10 is situated. Foot portion 40 extends generally inwardly of the wall portion 26 so that there are no outward protrusions from the side plate 12. Foot portion 40 includes a substantially planar portion 44 which abuts the floor 46 and which is integral with the lower edge 42 of wall portion 26. Arcuate portion 47 extends generally upwardly from the inner end of planar portion 44 and terminal portion 48 extends generally inwardly from the arcuate portion 47 and is disposed generally horizontally with respect to planar portion 44.

Figure 3:
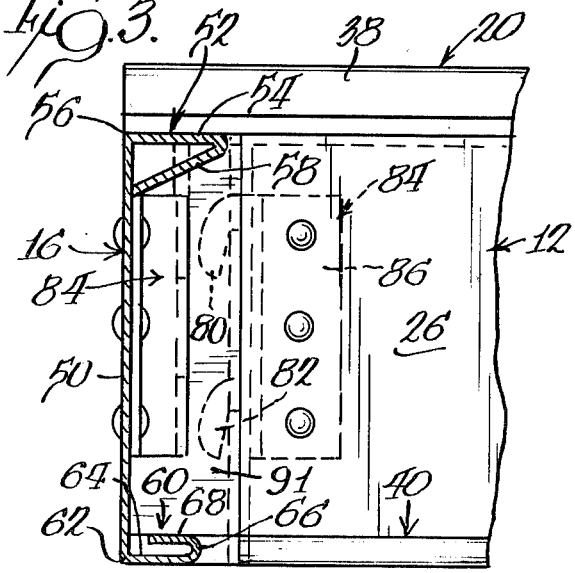
FIG. 3 is an enlarged, fragmentary cross-sectional view taken along line 3—3 of FIG. 1.

Two identical end plates 16 are disposed between the side plates 12 in spaced relationship with respect to the length of the side plates, and are oriented generally transversely of the side plates to form a generally rectangular platform. Each end plate 16 has substantially the same dimensions, as is best shown in FIG. 3, and each end plate 16 includes an intermediate portion 50 which is preferably of the same height as wall portion 26 of each side plate 12. Intermediate portion 50 is disposed in relation to the floor to provide upward support for the mattress and/or box spring, and preferably is generally planar and has a rectangular shape. An upper arm portion 52 extends from upper edge 54 of intermediate portion 50, and includes a substantially planar portion 56 which extends generally inwardly of and transversely to the intermediate portion 50. The upper arm portion also includes a downwardly depending angular portion 58 which may provide support for the planar member 56 to prevent the weight of the mattress and/or box spring from bending it in the downward direction. A lower leg portion 60 is integral with the lower edge 62 of the intermediate portion 50. Lower leg portion 60 includes a generally planar member 64 which extends inwardly from intermediate portion 50 and confronts the surface of the floor 46. A generally arcuate portion 66 extends generally upwardly of the planar portion from its innermost end, and the arcuate portion 66 is integral with a terminal portion 68 which extends generally outwardly with respect to the arcuate portion, and which is generally parallel to the planar portion 64.

When the end plates 16 are joined by connecting members to the side plates 12 to form a substantially rectangular platform, the upper surfaces of support portions 28 of the side plates 12 are coplanar with the upper surfaces of planar portions 56 of upper arm portions 52 of end plates 16. These coplanar surfaces coact to provide a peripheral support for bedding such as a mattress and box spring combination.

If a mattress and box spring combination is used on the platform, the box spring may be placed directly on the platform with its frame being supported on the coplanar surfaces defined by support portions 28 of side rails 12 and also on planar portions 56 of upper arm portions 52. Thus, the platform of the present invention may support an ordinary box spring/mattress combination which is commonly used with Hollywood bed frames. This provides the user with the same degree of sleeping comfort when using a platform bed in accordance with the present invention as is commonly available using Hollywood bed frames. Also, when the box spring is disposed on the platform, terminal portion 38 ideally abuts the mattress or box spring disposed on the support member 28 and prevents it from moving transversely with respect to the side plate 12 of the platform. If an ordinary mattress is used without a box spring, it may be supported on a flat board 39 or alternatively on slats, or on a flat board placed over the slats.

Figure 4:
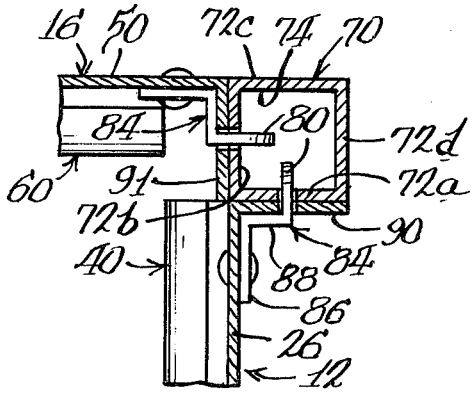
FIG. 4 is a fragmentary, cross-sectional view taken along line 4—4 of FIG. 2.
Figure 5:
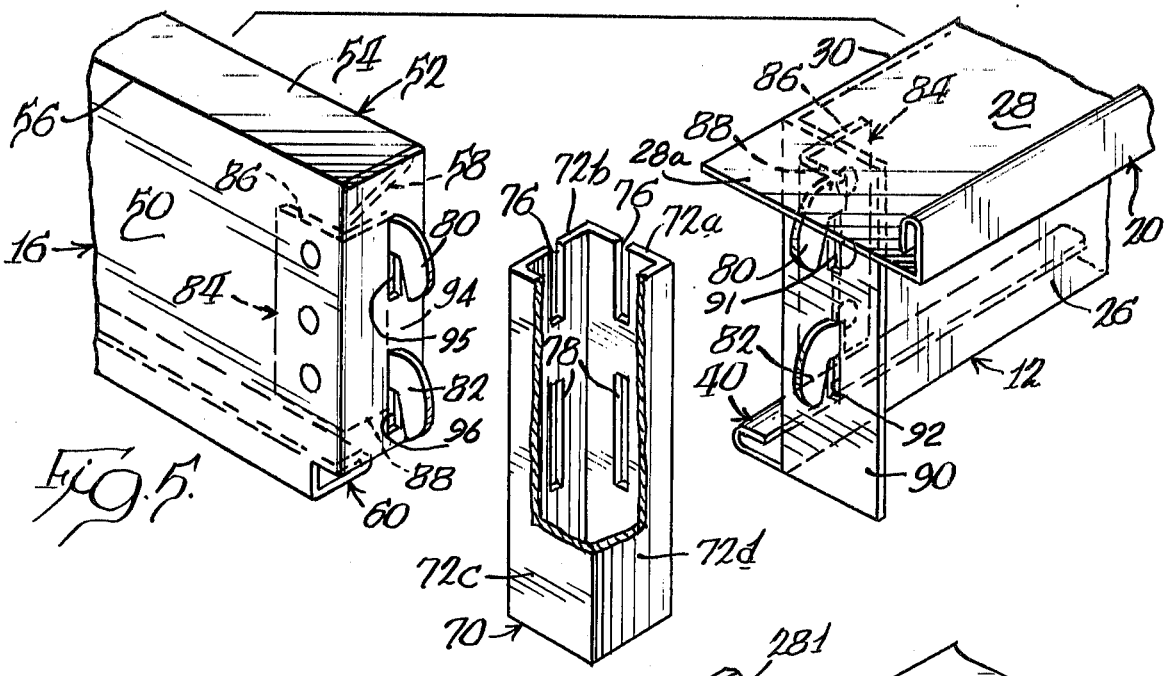
FIG. 5 is an exploded view of the joint illustrated in FIG. 4.

A first embodiment of the connecting members which join the side plates 12 and end plate 16 is illustrated in FIGS. 2–5. As is best shown in FIG. 4, joint 14 is formed of connecting members which include corner bracket members, tab bracket members, and flange members. Each of the corner bracket member 70 is made up of four generally rectangular planar sides *72a–d* to form a substantially rectangular member which has a square cross-section which encloses an open area 74. As shown best in FIG. 5, two sides *72a* and *72b* of corner bracket member 70 define a plurality of tab slots, or female members, 76 and 78 for receiving tab members, with one set of the slots on side *72a* disposed substantially transversely to the other set of slots on side *72b* so that the corner bracket member 70 may receive tabs 80 and 82 of two substantially transversely disposed tab bracket members 84.

The tab bracket members 84 are secured, as by riveting, to the end portions of the side plates 12 and end plates 16. Each tab bracket member 84 comprises a side portion 86 which may be secured to a side plate or end plate by riveting, welding, bolts, or the like. A front portion 88 is diposed generally transversely of side portion 86 and is integral therewith. Tabs 80 and 82 extend transversely and outwardly from front portion 88. Each tab 80 and 82 is generally planar, and has a generally curved configuration.

On each of the side plates 12, flange members 90 are integral with the end of the wall portion 26, and the flange members 90 extend generally transversely and outwardly of the wall portion. Each of the flange members 90 defines upper slot 91 and lower slot 92. Each of the tab bracket members 84 which is secured to an end of a side plate, has its front portion 88 in abutment with the flange member 90 so that upper tab 80 and lower tab 82 project through upper and lower slots 91 and 92 defined by flange member 90 with the upper edges of the tabs in abutment with the tops of the slots. This aids in rigidifying each of the tab bracket members 84 on the side plates 12 so that when the tabs are disposed in one of the slots 76 and 78 of corner bracket member 70, the tab bracket member will be securely supported on the side plate 12.

On each of the end plates 16, flange members 94 are integral with the end of the intermediate portion 50, and the flange members 94 extend generally transversely and inwardly of the intermediate portion. Each of the flange members 94 defines upper slot 95 and lower slot 96. Each of the tab bracket members 84 which is secured to an end of an end plate, has its front portion 88 in abutment with the flange member 94 so that upper tab 80 and lower tab 82 project through upper and lower slots 95 and 96 defined by flange member 94 with the upper edges of the tabs in abutment with the tops of the slots. This aids in rigidifying each of the tab bracket members 84 on the end plates 16 so that when the tabs are disposed in one of the slots 76 and 78 of corner bracket member 70, the tab bracket member will be securely supported on the side plate 12.

In this embodiment, the joint 14 is formed by inserting the tabs 80 and 82 of each tab bracket member 84 secured to the adjacent end of each side plate 12 into tab slots 76 and 78 on one face *72a* of the corner bracket member 70. And the tabs 80 and 82 of each tab bracket member 84 secured adjacent the ends of each end plate 16 is disposed in tabs slots 76 and 78 on face *72b*, which is substantially transverse to face *72a*, of corner bracket member 70. In this manner, the two smooth faces *72c* and *72d* of corner bracket member 70 form the visible portion of the joint 14. Also, when the joint is formed, an over hanging portion *28a* of support portion 28 of each side plate 12 substantially covers the top of corner bracket member 70.

Figure 7:
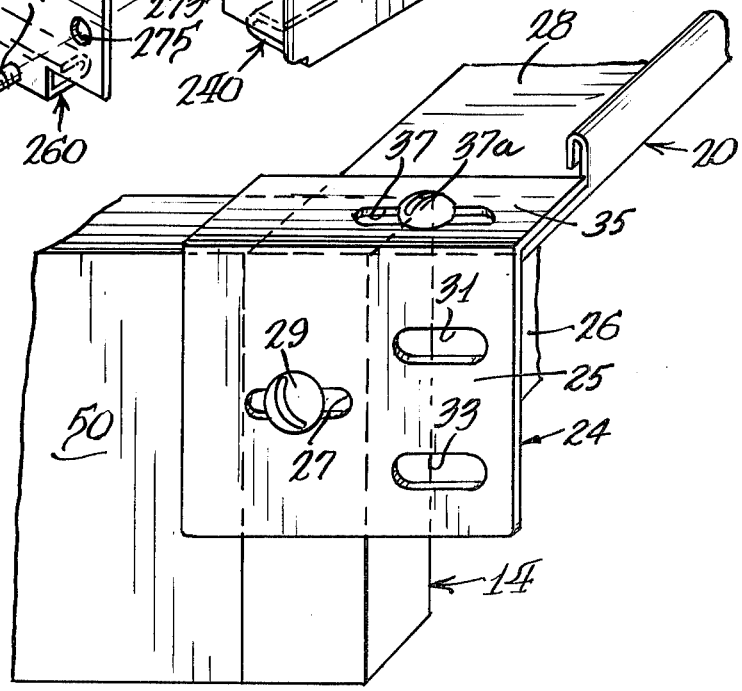
FIG. 7 is an exploded fragmentary perspective view of the platform shown in FIG. 1, illustrating a flange member for securing a headboard to the platform bed base.

One additional advantage of the present invention is that a headboard 22 may be secured to the head of the platform 10. A bracket 24 for securing headboard 22 to the head of platform 10 is illustrated in FIG. 7, and one bracket is provided on each side of the platform as indicated below. Headboard bracket 24 is generally L-shaped, and has a side portion 25 which may be secured to the back of the platform 10 preferably near a joint 14. For this purpose, headboard bracket 24 is provided with a slot or hole 27 on its side portion 25 so that it may be mounted on the platform 10 by a screw 29 or the like. The slots allow the bracket 24 to be adjusted to accomodate headboards of various size. Two additional slots, 31 and 33 for providing anchoring sites for a headboard as is commonly done in the art are provided generally outwardly of slot 27 on side portion 25 of bracket 24. Top portion 35 of bracket 24 is preferably at right angles to side portion 25 and is provided with a slot 37*a* so that top portion 35 may be secured to support portion 28 of side plate 12 by a screw 37, or the like. One bracket 24 is disposed on each end of the end plate 16 which defines the head of the platform 10.

Figure 6:
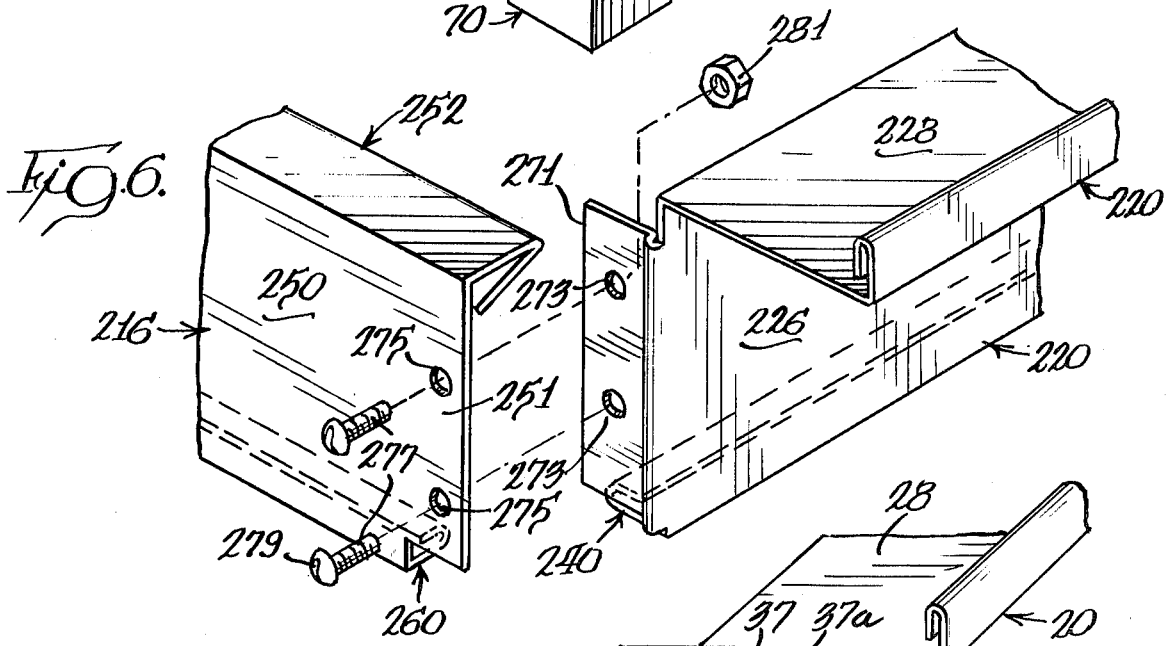
FIG. 6 is an exploded perspective view of a second embodiment of a joint between a side plate and an end plate of a platform in accordance with this invention.
Figure 12:
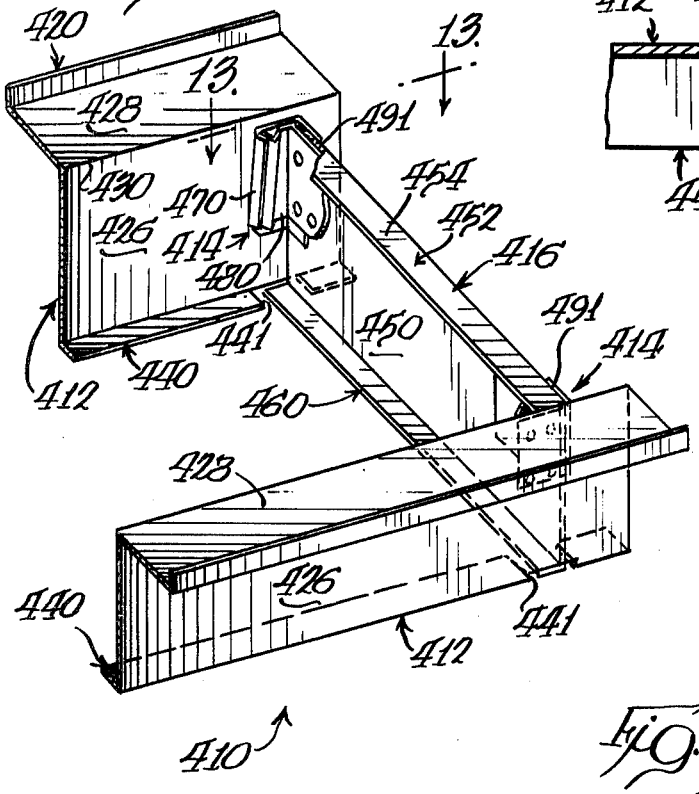
FIG. 12 is a fragmentry perspective view of a platform illustrating a fourth embodiment of coupling members for securing the end plates to the side plates of the platform.
Figure 13:
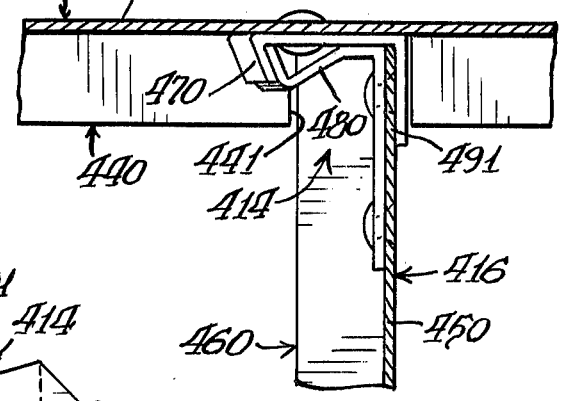
FIG. 13 is an enlarged plan view of the joint shown in FIG. 12 taken through line 13—13 of FIG. 12.
Figure 14:
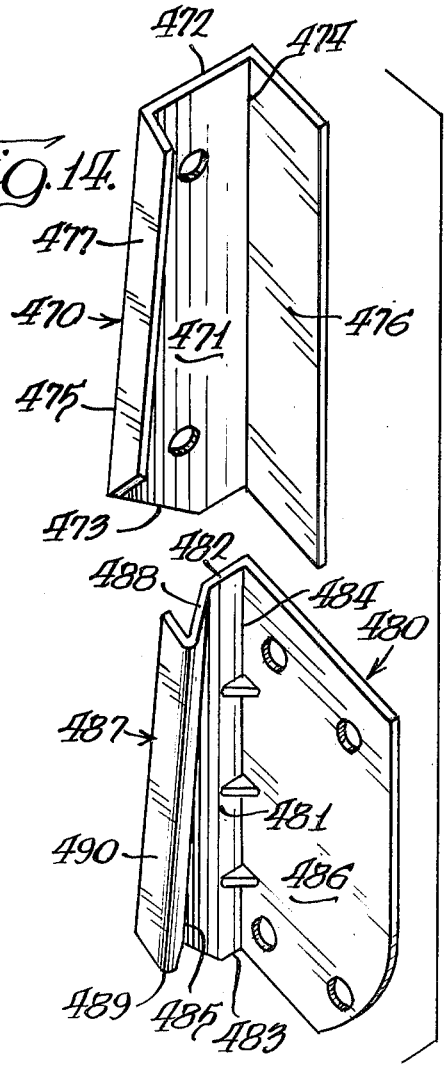
FIG. 14 is an exploded perspective view of the coupling members used to form the joint in FIG. 12; and, FIG. 15 is an enlarged perspective view of the joint illustrated in FIG. 12.
Figure 15:
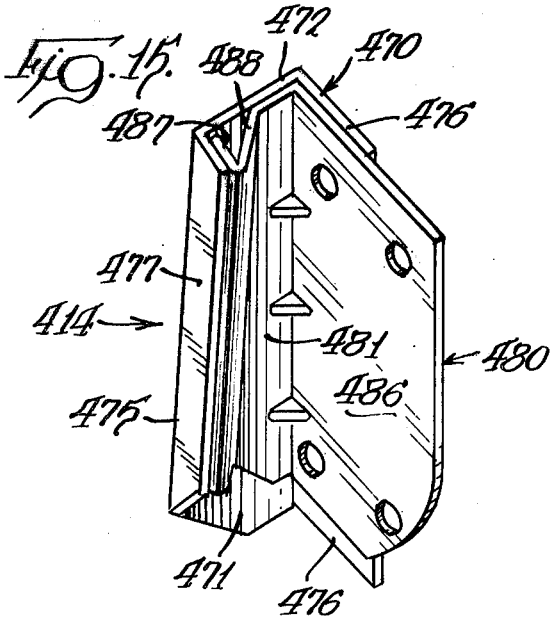

Another embodiment of the connecting members which form a joint 214 of the platform is shown in FIG. 6. In addition, a third embodiment of the connecting members which form a joint are shown in FIGS. 8–11, and a fourth embodiment is shown in FIGS. 12–14. The embodiment shown in FIG. 6 is numbered in the 200 series, with the last two digits of the numbers corresponding to identical parts in the embodiment shown in FIGS. 1–5 unless otherwise mentioned. Similarly, the third embodiment shown in FIGS. 8–11 is numbered in the 300 series, and the fourth embodiment shown in FIGS. 12–15 is numbered in the 400 series.

In the second embodiment, a flange member 271 is integral with each end of each wall portion 226 of each of the side plates 212. The flange member 271 is oriented substantially inwardly and transversely of the wall portion 226, and defines a plurality of openings 273. The terminal portion 251 of each end of the intermediate portion 250 of each end plate also defines a plurality of openings 275 which are spaced so that they may be placed in substantial alignment with the openings 273 defined by the flange member 271 when the flange member is placed in abutment with the terminal portion 251 of the end plate. A plurality of male members such as screws 277 having enlarged heads 279 at one end, are disposed in the openings 273 and 275 with their enlarged heads 279 in abutment with the outer side of the terminal portion 251 of the end plate 216. Female members, such as nuts 281, or the like, are disposed on the screws to secure the flange members 271 of the side plates 212 and terminal portions 251 of the end plates 216 together.

Figure 11:
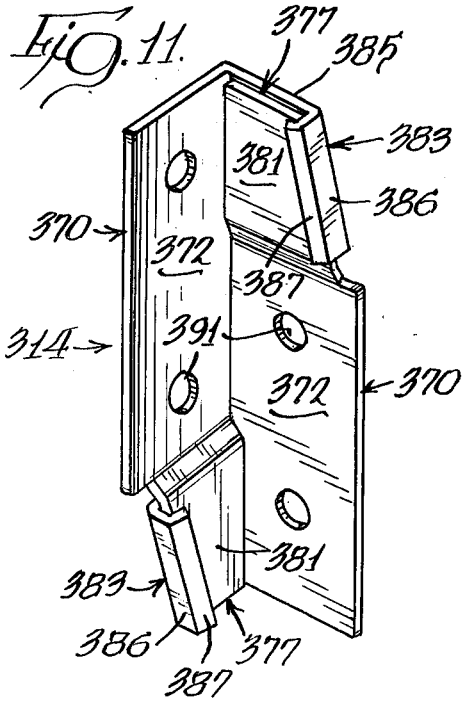
FIG. 11 is an enlarged perspective view of one joint formed by the two coupling members shown in FIG. 10.

A third embodiment of coupling members useful in the present invention is illustrated in FIGS. 8–11. Coupling member 370 comprises a generally planar central body portion 372 having an upper edge 373 and a lower edge 374 and side edges 375 and 376. A male portion 377 extends generally upwardly of the central body portion 372 and generally inwardly thereof. Male portion 377 is tapered so that its outer end 378 has a narrower width than its inner end 379. Male portion 377 generally includes a small connecting portion 380 which slopes inwardly of central body portion 372, and a generally planar portion 381 which extends generally upwardly of connecting portion 380. A female portion 383 is disposed on a side edge 375 of coupling member 370. Female portion 383 is shaped so that it can receive tapered male portion 377 from an adjacently disposed coupling member and retain the male portion in clamped relationship therewith. Female portion 383 is integral with central body portion 372 and disposed adjacent a side edge of the central body portion in a substantially L-shaped arrangement therewith. The lower end 384 of the female portion 383 is preferably substantially coextensive with the lower edge 374 of central body portion 372. The female portion 383 is tapered so that its width is smaller at its lower end 384 is than at its upper end 385. Female portion 383 generally includes an inner section 385 having a shape corresponding to the shape of male portion 377. An intermediate section 386 extends substantially inwardly of the inner portion 385 and generally transversely thereof, and serves to limit sideways movement of a male member 377 of an adjacent coupling member disposed therein. Outer portion 387 of female portion 383 extends generally inwardly of the intermediate section 385 and toward the central body portion 376. Thus, outer portion 387 and intermediate portion 386 of female portion 383 serves to hold male portion 377 against inner portion 385 so that the female portion 383 may slidingly interlock with the male portion 377 of an adjacent coupling member to form a joint 314 as is shown in FIG. 11.

The side plates 312 and end plates 316 of the platform 310 are slightly modified in order to use the coupling members illustrated in FIGS. 8–11. Each side plate 312 is provided in its foot portion 340 with a notch 341. A coupling member 370 is disposed on the outer end portion 390 of the intermediate portion 350 of each end plate 316 with an edge of the coupling member generally aligned with the outer edge 354 of the intermediate portion 350 of end plate 316. Coupling member 370 is secured to the intermediate portion 300 of end plate 316 by securing means which are well known in the art, such as by riveting along holes 391 defined in central body portion 372 of coupling member 370, or any other suitable means that are well known in the art. The coupling member 370 may be secured to end plate 316 either with its male portion 377 upwardly directed or downwardly directed.

Figure 8:
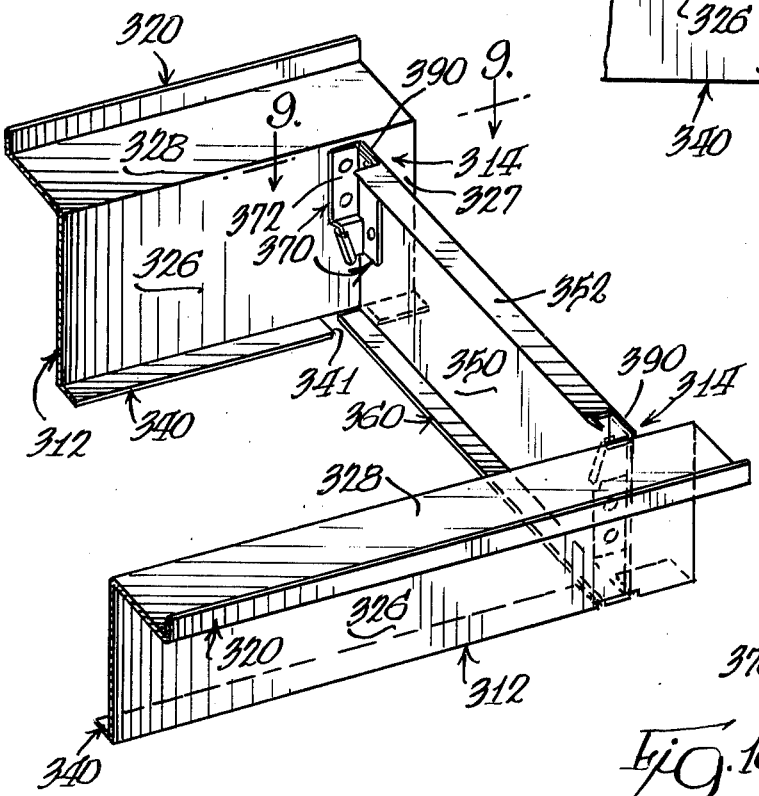
FIG. 8 is a fragmentary perspective view of a platform illustrating a third embodiment of coupling members for securing the end plates to the side plates of the platform.
Figure 9:
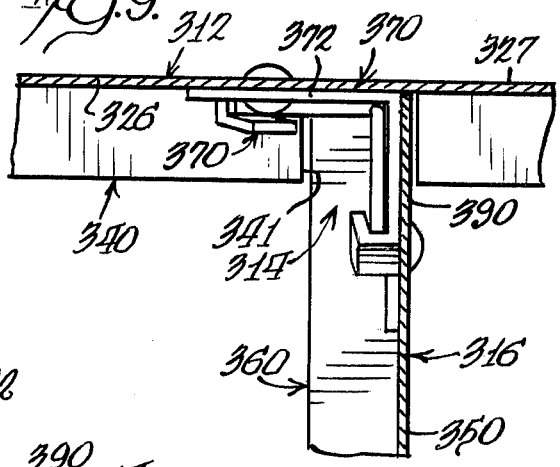
FIG. 9 is an enlarged fragmentary cross-sectional view taken along line 9—9 of FIG. 8.
Figure 10:
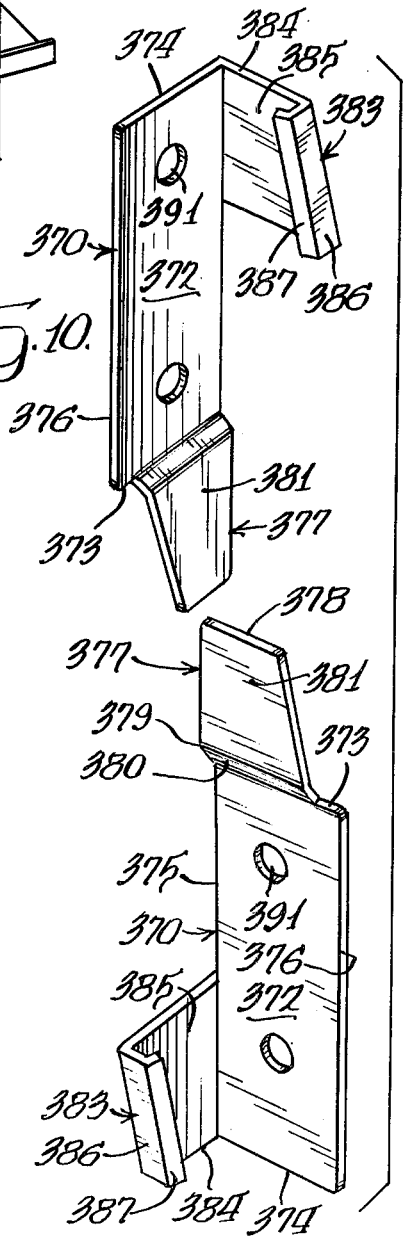
FIG. 10 is an exploded perspective view of the coupling members used to form the joint in FIG. 8.

A coupling member 370 is also secured to the wall portion 326 of side plate 312 at a location which is generally above notch 341. Coupling member 370 is secured to wall portion 326 with its central body portion 372 aligned generally parallel to the outer edge 327 of wall portion 326. The coupling member 370 disposed on wall portion 326 is disposed with its male member 377 oriented inversely to the male member 377 of the coupling member 370 which is disposed on end plate 316 so that the male member 377 of each of the coupling members 370 may be slidingly disposed in the female member 383 of the other coupling member to form a joint 314 as is illustrated in FIGS. 8 and 11. Thus, each end plate 316 may be secured to each side plate 312 by sliding the male members 377 of the coupling members 370 into the female members 383 of inversely disposed adjacent coupling members to interlock the coupling members and form a substantially L-shaped joint 314 whereby the side plates and end plates are mounted relatively rigidly in interlocking relationship with one another by the reaction forces of the side plates 312 and end plates 316 with the floor and the mattress to form a relatively rigid platform bed.

In the embodiment illustrated in FIGS. 8–11, the side plate 312 has a slightly different configuration then the side plate 12 of the embodiment illustrated in FIGS. 1–6. In side plate 312 the flange 320 is a substantially planar member which extends generally upwardly from support portion 328 as opposed to the flange 20 of side plate 12 which has a planar portion 34, an arcuate portion 36 and a depending terminal portion 38. Similarly, the foot portion 340 is a substantially planar member which extends generally transversely of wall portion 326, as opposed to foot portion 40 of side plate 12 which includes a planar portion 44, an arcuate portion 47 and a terminal portion 48. Also, in the embodiments illustrated in FIGS. 8–11, the leg portion 360 of end plate 316 has a configuration similar to the foot portion 340 of side plate 312. Although the connecting members, which form the joints of the platform, are illustrated with respect to specific embodiments of the side plates and end plates, it should be emphasized that any of the different forms of connecting members may be used with any of the embodiments of the side plates or end plates.

A fourth embodiment of the coupling or connecting members is illustrated in FIGS. 12–15, and includes a plurality of paired coupling members. One of the coupling members of the pair comprises a female member 470. The female member has a central portion 471 having an upper edge 472, a lower edge 473, and two side edges 474 and 475. The central portion 471 is narrower at its upper edge 472 than at its lower edge 473. A side portion 476 is integral with one side 474 of the central portion 471 and extends generally transversely of the central portion. A flange portion 477 is integral with the other side 475 of the central portion 471 and extends generally angularly of the central portion and substantially the same direction as the side portion 476.

The other member of the pair, the male member 480, includes a central portion 481 having a top edge 482 and a bottom edge 483 and two side edges 484 and 485. The top edge 482 of the male member is narrower than the bottom edge 483, and a side portion 486 is integral with one of the side edges 484 of the central portion 481 and extends generally transversely thereof. A flange portion 487 is integral with the other side 485 of the central portion 481 and extends generally outwardly thereof. The flange portion 487 includes a substantially planar portion 488 extending angularly with respect to the central portion 481 and in the same general direction as the side portion 486. An arcuate portion 489 is integral with the generally planar portion 487, and a terminal portion 490 extending generally in the opposite direction as the generally planar portion 487 is integral with the arcuate portion 489 so that the planar portion 488, arcuate portion 489, and terminal portion 490, form a substantially V-shaped configuration. Each end plate 416 has one of the male and female coupling members disposed adjacent each end 491 of its intermediate portion 450. The other of the male and female coupling members is disposed on each side plate 412 near each end of each wall portion 426.

In the illustrated embodiment, the male member 480 is disposed adjacent each end 491 of the intermediate portion 450 of each end plate 416 with its upper edge 482 near the upper edge 454 of the intermediate portion 450. A female member 470 is disposed near each end 427 of each side plate 412 on its wall portion 426 at a height with respect to its foot portion 440 which permits the male member 480 disposed on the end plate 416 to be slidingly interlocked with the female member 470 so that the end plate and side plate form a generally L-shaped joint 414 with the leg portion 460 of the end plate 416 and the foot portion 440 of the side plate 412 resting on the floor. Because the female coupling member 470 is disposed near the end of each side plate, and not adjacent thereto, a portion of the foot portion of the side plate is notched so that the leg portion of the end plate may rest on the floor when the end plate 416 and side plate 412 are interlocked through the coupling members.

This invention is defined solely by the appended claims. When used in the claims, the term mattress means defines any element or combination of elements which function as a common mattress and includes, inter alia, an ordinary mattress with support means such as a board or slats, a mattress and box spring combination, a separate box spring supporting an ordinary mattress, and a mattress specially made for use on a platform bed frame. Also, when used in the claims, the word platform is intended to denote a platform bed frame.

We claim:

1. A platform bed frame for supporting mattress means in spaced relationship to a floor comprising:

a pair of spaced parallel side plates, each side plate having substantially the same dimensions and including a wall portion having an upper edge and a lower edge and disposed in relation to the floor to provide upright support for said mattress means, a support portion for providing support for a peripheral part of said mattress means, the support portion integral with the upper edge of the wall portion and disposed generally transversely of and extending outwardly of the wall portion to provide support for said mattress means, a flange member extending generally upwardly of and integral with said support portion for preventing lateral movement of said mattress means with respect to said platform, said flange member including a generally planar portion extending upwardly of said support portion and integral therewith, an arcuate portion extending generally inwardly of said planar portion and integral therewith, and a terminal portion extending generally downwardly of said arcuate portion and integral therewith, and a foot portion integral with the lower edge of said wall portion for confronting the surface upon which the platform is situated, said foot portion extending generally inwardly of said wall portion and including a substantially planar portion integral with said wall portion and extending inwardly of said substantially planar portion and integral therewith, a pair of longitudinally spaced end plates extending substantially transversely between said side plates, each end plate having substantially the same dimensions and including an intermediate portion having an upper edge and a lower edge and two ends and disposed in relation to the floor to provide upright support for said mattress means, an upper arm portion for supporting a peripheral portion of said mattress means, the upper arm portion integral with the upper edge of the intermediate portion, and a lower leg portion integral with the lower edge of the intermediate portion for confronting the surface upon which said platform is situated; and means for detachably securing each of said end plates to each of said side plates to form a generally rectangular platform.

2. The platform bed frame of claim 1 wherein said upper arm portion comprises a substantially planar member extending inwardly of said intermediate portion and integral therewith and a downwardly depending angular portion for providing support for the planar member and integral therewith, and said lower leg portion comprises a generally planar member extending generally inwardly of said intermediate portion and integral therewith, an arcuate member extending generally upwardly of said planar member and integral therewith, and a terminal member extending generally outwardly with respect to said arcuate member and integral therewith.

3. The platform bed frame of claim 1 wherein the means for detachably securing each of said end plates to said side plates to form a generally rectangular platform comprises:

corner bracket members defining a plurality of tab slots for receiving tab members, with some of said slots disposed substantially transversely to the remainder of said slots so that said corner bracket member may receive tab members of two substantially transversely disposed tab bracket members, tab bracket members comprising a side portion for anchoring said tab bracket member onto a side plate or end plate, a front portion disposed generally transversely of said side portion, and tabs extending generally transversely outwardly from said front portion, said flange members integral with the ends of the wall portions of said side plates and extending generally transversely and inwardly of said wall portions, said flange members defining slots for allowing the tabs to project therethrough, each slot having a top and a bottom, some of the tab bracket members secured to the wall portion of said side plates with the front portion of each tab bracket member in abutment with the flange member of the side plates, each of the tabs projecting through the slots of the flange members of the side plates with the upper edges of the tabs in abutment with the tops of said slots to rigidify each of said tab bracket members on said side plates, the remainder of said tab bracket members secured adjacent each end of the intermediate portion of each of said end plates, said tabs of each of said tab bracket members secured to the intermediate portion of each of said end plates disposed in one set of said tab slots on said corner bracket members with the front portion of each tab bracket member adjacent said corner bracket member, the tab slots of each of said tab bracket members secured to the wall portion of each of said side plates disposed in the other set of transversely oriented tab slots on said corner brackets to form a joint.

4. The platform bed frame of claim 1 wherein the means for detachably securing each of said end plates to each of said side plates to form a generally rectangular platform comprising a flange member, said flange member integral with one of said ends of said wall portions of said side plates and said intermediate portions of said end plates, each of said flange members oriented generally inwardly and transversely of said end and defining a plurality of openings, a terminal portion of the other of said ends not having a flange member abutting said flange member and defining a plurality of openings in substantial alignment with the openings of said flange member, and a plurality of male members having enlarged heads at one end, said male members disposed in said openings with their enlarged heads in abutment with one of the flange members and the terminal portion, and female members for engaging with said male members, said female members cooperating with said male members to secure the flange members and terminal portions together.

5. The platform bed frame of claim 1 wherein the means for detachably securing each of said end plates to each said side plates to form a generally rectangular platform includes a plurality of identical coupling members for detachably securing said end plates to said side plates to form a generally rectangular platform, each of said coupling members comprising a generally planar central body portion having an upper edge, a lower edge, and side edges, a male portion extending generally upwardly of said central body portion from its upper edge, said male portion having an upper end and a lower end being tapered so that its upper end has a narrower width than its lower end, and a female portion having an upper end and a lower end for slidably receiving a tapered male portion from an adjacently disposed coupling member, said female portion integral with said central body portion and disposed adjacent a side edge of said central body portion in a substantially L-shaped arrangement therewith, the lower end of said female portion being substantially coextensive with the lower edge of said central body portion, said female portion being tapered so that its width is smaller at its lower end than at its upper end, said female portion including an inner section having a shape corresponding to the shape of the male portion, an intermediate section extending substantially inwardly of and transversely to said inner section, and an outer flange section extending generally inwardly of said intermediate section and toward said central body portion so that the female portion may slidingly interlock with the male portion of an adjacent coupling member, and wherein said coupling members are secured to said wall portions of said side plates and said intermediate portions of said end plates near each end thereof with each coupling member secured to each end of each of said end plates inversely oriented with respect to each complementarily disposed coupling member secured near each end of said side plates so that each joint comprises a pair of inversely oriented coupling members, with the male portion of each coupling member in said joint disposed in the female portion of each adjacent coupling member to thereby form a substantially L-shaped joint whereby said side plates and said end plates are mounted relatively rigidly in interlocking relationship with one another by forces applied to said support portions and upper arm portions by said mattress means and the reaction forces of said foot portions of said side plates and leg portions of said end plates against the floor upon which the platform is situated.

6. The platform bed frame of claim 1 wherein the means for detachably securing each of said end plates to each of said side plates to form a generally rectangular platform include a plurality of paired coupling members, one of said pair of said coupling members comprising a female member, the female member including a central portion having an upper edge, a lower edge, and two side edges, said central portion narrower at its upper edge than at its lower edge, a side portion integral with one side edge of said central portion and extending generally transversely of said central portion, and a flange portion integral with the other side edge of said central portion and extending generally angularly thereof in substantially the same direction as said side portion, the other of said pair of said coupling members comprising a male member, said male member including a central portion having a top edge and a bottom edge and two side edges, the top edge of said male member narrower than the bottom edge, a side portion integral with one of the side edges of said central portion and extending generally transversely thereof, and a flange portion integral with the other side of the central portion and extending generally outwardly thereof in the same general direction as said side portion, said flange portion including a substantially planar portion extending angularly with respect to said central portion and in the same general direction as the side portion, an arcuate portion integral with the generally planar portion, and a terminal portion extending generally in the opposite direction as the generally planar portion to form a substantially V-shaped configuration, each end plate having one of said male and female coupling members secured thereto adjacent each end of its intermediate portion, and the other of said male and female coupling members secured to said side plate near each end of each wall portion in complementary relationship with the coupling members disposed on the intermediate portions of said end plates so that the male member is disposed in said female member in interlocking relation therewith to provide a joint between said side plate and said end plate whereby each side said plate and each said end plate are mounted relatively rigidly in interlocking relationship with one another by gravitional forces acting on said joint through said side plates and end plates.

7. A platform bed frame for supporting mattress means in spaced relationship to a floor comprising:

a pair of spaced parallel side plates, each side plate having substantially the same dimensions and including a wall portion having an upper edge and a lower edge and two ends and disposed in relation to the floor to provide upright support for said mattress means, a support portion for providing support for a peripheral part of said mattress means, the support portion integral with the upper edge of the wall portion and including a flange portion for preventing lateral movement of said mattress means, and a foot portion integral with the lower edge of the wall portion for confronting the surface upon which the platform is situated;

a pair of longitudinally spaced end plates extending substantially transversely between said side plates, each end plate having substantially the same dimensions and including an intermediate portion having an upper edge and a lower edge and two ends and disposed in relation to the floor to provide upright support for said mattress means, an upper arm portion for supporting a peripheral portion of said mattress means, the upper arm portion integral with the upper edge of the intermediate portion, and a lower leg portion integral with the lower edge of the intermediate portion for confronting the surface upon which said platform is situated; and a plurality of identical coupling members for detachably securing said end plates to said side plates to form a generally rectangular platform, each of said coupling members comprising a generally planar central body portion having an upper edge, a lower edge, and side edges, a male portion extending generally upwardly of said central body portion from its upper edge, said male portion having an upper end and a lower end being tapered so that its upper end has a narrower width than its lower end, and a female portion having an upper end and a lower end for slidably receiving a tapered male portion from an adjacently disposed coupling member, said female portion integral with said central body portion and disposed adjacent a side edge of said central body portion in a substantially L-shaped arrangement therewith, the lower end of said female portion being substantially coextensive with the lower edge of said central body portion, said female portion being tapered so that its width is smaller at its lower end than at its upper end, said female portion including an inner section having a shape corresponding to the shape of the male portion, an intermediate section extending substantially inwardly of and transversely to said inner section, and an outer flange section extending generally inwardly of said intermediate section and toward said central body portion so that the female portion may slidingly interlock with the male portion of an adjacent coupling member, and wherein said coupling members are secured to said wall portions of said side plates and said intermediate portions of said end plates near each end thereof with each coupling member secured to each end of each of said end plates inversely oriented with respect to each complementarily disposed coupling member secured near each end of said side plates so that each joint comprises a pair of inversely oriented coupling members, with the male portion of each coupling member in said joint disposed in the female portion of each adjacent coupling member to thereby form a substantially L-shaped joint whereby said side plates and said end plates are mounted relatively rigidly in interlocking relationship with one another by forces applied to said support portions and upper arm portions by said mattress means and the reaction forces of said foot portions of said side plates and leg portions of side end plates against the floor upon which the platform is situated.

8. The platform bed frame of claim 7 wherein the support portion is disposed generally transversely of and extending outwardly of the wall portion, flange member includes a generally planar portion extending upwardly of said support portion and integral therewith, an arcuate portion extending generally inwardly of said planar portion and integral therewith, and a terminal portion extending generally downwardly of said arcuate portion and integral therewith.

9. The platform bed frame of claim 8 wherein the foot portion extends generally inwardly of said wall portion and including a substantially planar portion integral with said wall portion and extending inwardly of said substantially planar portion and integral therewith, and a terminal portion extending generally outwardly of said arcuate portion.

10. The platform bed frame of claim 7 wherein said upper arm portion comprises a substantially planar member extending inwardly of said intermediate portion and integral therewith and a downwardly depending angular portion for providing support for the planar member and integral therewith.

11. The platform bed frame of claim 10 wherein said lower leg portion comprises a generally planar member extending generally inwardly of said intermediate portion and integral therewith, an arcuate member extending generally upwardly of said planar member and integral therewith, and a terminal member extending generally outwardly with respect to said arcuate member and integral therewith.

12. A platform bed frame for supporting mattress means in spaced relationship to a floor comprising:

a pair of spaced parallel side plates, each side plate having substantially the same dimensions and including a wall portion having an upper edge and a lower edge and two ends and disposed in relation to the floor to provide upright support for said mattress means, a support portion for providing support for a peripheral part of said mattress means, the support portion integral with the upper edge of the wall portion and including flange means for preventing lateral movement of said mattress means, and a foot portion integral with the lower edge of the wall portion for confronting the surface upon which the platform is situated;

a pair of longitudinally spaced end plates extending substantially transversely between said side plates, each end plate having substantially the same dimensions and including an intermediate portion having an upper edge and a lower edge and two ends and disposed in relation to the floor to provide upright support for said mattress means, an upper arm portion for supporting a peripheral portion of said mattress means, the upper arm portion integral with the upper edge of the intermediate portion, and a lower leg portion integral with the lower edge of the intermediate portion for confronting the surface upon which said platform is situated; and means for detachably securing each of said end plates to each of said side plates to form a generally rectangular platform.

13. The platform bed frame of claim 12 wherein the support portion is disposed generally transversely of and extending outwardly of the wall portion, the flange means is defined by a flange portion that extends generally upwardly of and integral with said support portion and includes a generally planar portion extending upwardly of said support portion and integral therewith, an arcuate portion extending generally inwardly of said planar portion and integral therewith, and a terminal portion extending generally downwardly of said arcuate portion and integral therewith, and said foot portion extends generally inwardly of said wall portion and includes a substantially planar portion integral with said portion and extending inwardly of said substantially planar portion and integral therewith, and a terminal portion extending generally outwardly of said arcuate portion.

14. The platform bed frame of claim 12 wherein said upper arm portion comprises a substantially planar member extending inwardly of said intermediate portion and integral therewith and a downwardly depending angular portion for providing support for the planar member and integral therewith, and said lower leg portion comprises a generally planar member extending generally inwardly of said intermediate portion and integral therewith, an arcuate member extending generally upwardly of said planar member and integral therewith, and a terminal member extending generally outwardly with respect to said arcuate member and integral therewith.

15. The platform bed frame of claim 12 wherein the means for detachably securing each of said end plates to said side plates to form a generally rectangular platform comprises:

corner bracket members defining a plurality of tab slots for receiving tab members, with some of said slots disposed substantially transversely to the remainder of said slots so that said corner bracket member may receive tab members of two substantially transversely disposed tab bracket members, tab bracket members comprising a side portion for anchoring said tab bracket member onto a side plate or end plate, a front portion disposed generally transversely of said side portion, and tabs extending generally transversely outwardly from said front portion, said flange means being defined by flange members integral with the ends of the wall portions of said side plates and intermediate portions of said end plates, the flange members on said side plates extending transversely and outwardly of said wall portions and the flange members on said end plates extending inwardly of said intermediate portions, said flange members defining slots for allowing the tabs to project therethrough, each slot having a top and a bottom, some of the tab bracket members secured to the wall portions of said side plates with the front portion of each tab bracket member in abutment with the flange member of the side plates, each of the tabs projecting through the slots of the flange members of the side plates with the upper edges of the tabs in abutment with the tops of said slots to rigidify each of said tab bracket members on said side plates, the remainder of said tab bracket members secured to the wall portions of said end plates with the front portion of each tab bracket member in abutment with the flange member of the side plates, each of the tabs projecting through the slots of the flange members on the side plates with the upper edges of the tabs in abutment with the tops of said slots to rigidify each of said tab bracket members on said end plates, said tabs of each of said tab bracket members secured to the intermediate portion of each of said end plates disposed in one set of said tab slots on said corner bracket members with the front portion of each tab bracket member adjacent said corner bracket member, the tab slots of each of said tab bracket members secured to the wall portion of each of said side plates disposed in the other set of transversely oriented tab slots on said corner brackets to form a joint.

16. The platform bed frame of claim 12 wherein the means for detachably securing each of said end plates to each said side plates to form a generally rectangular platform comprises:

a flange member, said flange member integral with one of said ends of said wall portions of said side plates and said intermediate portons of said plates, each of said flange members oriented generally inwardly and transversely of said end and defining a plurality of openings, a terminal portion of the other of said ends not having a flange member abutting said flange member and defining a plurality of openings in substantial alignment with the openings of said flange member, and a plurality of male members having enlarged heads at one end, said male members disposed in said openings with their enlarged heads in abutment with one of the flange members and the terminal portion, and female members for engaging with said male members, said female members cooperating with said male members to secure the flange members and terminal portions together.

17. The platform bed frame of claim 12 wherein the means for detachably securing each of said end plates to each said side plates to form a generally rectangular platform comprises:

a plurality of identical coupling members for detachably securing said end plates to said side plates to form a generally rectangular platform, each of said coupling members comprising a generally planar central body portion having an upper edge, a lower edge, and side edges, a male portion extending generally upwardly of said central body portion from its upper edge, said male portion having an upper end and a lower end being tapered so that its upper end has a narrower width than its lower end, and a female portion having an upper end and a lower end for slidably receiving a tapered male portion from an adjacently disposed coupling member, said female portion integral with said central body portion and disposed adjacent a side edge of said central body portion in a substantially L-shaped arrangement therewith, the lower end of said female portion being substantially coextensive with the lower edge of said central body portion, said female portion being tapered so that its width is smaller at its lower end than at its upper end, said female portion including an inner section having a shape corresponding to the shape of the male portion, an intermediate section extending substantially inwardly of and transversely to said inner section, and an outer flange section extending generally inwardly of said intermediate section and toward said central body portion so that the female portion may slidingly interlock with the male portion of an adjacent coupling member, and wherein said coupling members are secured to said wall portions of said side plates and said intermediate portions of said plates near each end thereof with each coupling member secured to each end of each of said end plates inversely oriented with respect to each complementarily disposed coupling member secured near each end of said side plates so that each joint comprises a pair of inversely oriented coupling members, with the male portion of each coupling member in said joint disposed in the female portion of each adjacent coupling member to thereby form a substantially L-shaped joint whereby said side plates and said end plates are mounted relatively rigidly in interlocking relationship with one another by forces applied to said support portions and upper arm portions by said mattress means and the reaction forces of said foot portions of said side plates and leg portions of side end plates against the floor upon which the platform is situated.

18. The platform bed frame of claim 12 wherein the means for detachably securing each of said end plates to each of said side plates to form a generally rectangular platform include a plurality of paired coupling members, one of said pair of said coupling members comprising a female member, the female member including a central portion having an upper edge, a lower edge, and two side edges, said central portion narrower at its upper edge than at its lower edge, a side portion integral with one side edge of said central portion and extending generally transversely of said central portion, and a flange portion integral with the other side edge of said central portion and extending generally angularly thereof in substantially the same direction as said side portion, the other of said pair of said coupling members comprising a male member, said male member including a central portion having a top edge and a bottom edge and two side edges, the top edge of said male member narrower than the bottom edge, a side portion integral with one of the side edges of said central portion and extending generally transversely thereof, and a flange portion integral with the other side of the central portion and extending generally outwardly thereof in the same general direction as said side portion, said flange portion including a substantially planar portion extending angularly with respect to said central portion and in the same general direction as the side portion, an arcuate portion integral with the generally planar portion, and a terminal portion extending generally in the opposite direction as the generally planar portion to form a substantially V-shaped configuration, each end plate having one of said male and female coupling members secured thereto adjacent each end of its intermediate portion, and the other of said male and female coupling members secured to said side plate near each end of each wall portion in complementary relationship with the coupling members disposed on the intermediate portions of said end plates so that the male member is disposed in said female member in interlocking relation therewith to provide a joint between said side plate and said end plate whereby each said side plate and each said end plate are mounted relatively rigidly in interlocking relationship with one another by gravitional forces acting on said joint through said side plates and end plates.

19. A platform bed frame for supporting mattress means in spaced relationship to a floor comprising:

a pair of spaced parallel side plates, each side plate having substantially the same dimensions and including a wall portion having an upper edge and a lower edge and two ends and disposed in relation to the floor to provide upright support for said mattress means, a support portion for providing support for a peripheral part of said mattress means, the support portion integral with the upper edge of the wall portion and including flange means portion for preventing lateral movement of said mattress means, and a foot portion integral with the lower edge of the wall portion for confronting the surface upon which the platform is situated;

a pair of longitudinally spaced end plates extending substantially transversely between said side plates, each end plate having substantially the same dimensions and inincluding an intermediate portion having an upper edge and a lower edge and disposed in relation to the floor to provide upright support for said mattress means, an upper arm portion integral with the upper edge of the intermediate portion for supporting a peripheral portion of said mattress means, said upper arm portion comprising a substantially planar member extending inwardly of said intermediate portion and integral therewith and a downwardly depending angular portion for providing support for the planar member and integral therewith, and a lower leg portion integral with the lower edge of the intermediate portion for confronting the surface upon which said platform is situated, said lower leg portion comprising a generally planar member extending generally inwardly of said intermediate portion and integral therewith, an arcuate member extending generally upwardly of said planar member and integral therewith, and a terminal member extending generally outwardly with respect to said arcuate member and integral therewith; and means for detachably securing each of said end plates to each of said side plates to form a generally rectangular platform.

20. The platform bed frame of claim 19 wherein the support portion is disposed generally transversely of and extends outwardly of the wall portion to provide support for said mattress means, said flange member includes a generally planar portion extending upwardly of said support portion and integral therewith, an arcuate portion extending generally inwardly of said planar portion and integral therewith, and a terminal portion extending generally downwardly of said arcuate portion and integral therewith, and said foot portion extends generally inwardly of said wall portion and includes a substantially planar portion integral with said wall portion and extending inwardly of said substantially planar portion and integral therewith, and a terminal portion extending generally outwardly of said arcuate portion.

21. The platform bed frame of claim 19 wherein the means for detachably securing each of said end plates to said side plates to form a generally rectangular platform comprises:

corner bracket members defining a plurality of tab slots for receiving tab members, with some of said slots disposed substantially transversely to the remainder of said slots so that said corner bracket member may receive tab members of two substantially transversely disposed tab bracket members, tab bracket members comprising a side portion for anchoring said tab bracket member onto a side plate or end plate, a front portion disposed generally transversely of said side portion, and tabs extending generally transversely outwardly from said front portion, flange members integral with the ends of the wall portions of said side plates and extending generally transversely and inwardly of said wall portions, said flange members defining slots for allowing the tabs to project therethrough, each slot having a top and a bottom, some of the tab bracket members secured to the wall portion of said side plates with the front portion of each tab bracket member in abutment with the flange member of the side plates, each of the tabs projecting through the slots of the flange members of the side plates with the upper edges of the tabs in abutment with the tops of said slots to rigidify each of said tab bracket members on said side plates, the remainder of said tab bracket members secured adjacent each end of the intermediate portion of each of said end plates, said tabs of each of said tab bracket members secured to the intermediate portion of each of said end plates disposed in one set of said tab slots on said corner bracket members with the front portion of each tab bracket member adjacent said corner bracket member, the tab slots of each of said tab bracket members secured to the wall portion of each of said side plates disposed in the other set of transversely oriented tab slots on said corner brackets to form a joint.

22. The platform bed frame of claim 19 wherein the means for detachably securing each of the end plates to the side plates comprises a flange member, said flange member integral with one of said ends of said wall portions of said side plates and said intermediate portions of said end plates, each of said flange members oriented generally inwardly and transversely of said end and defining a plurality of openings, a terminal portion of the other of said ends not having a flange member abutting said flange member and defining a plurality of openings in substantial alignment with the openings of said flange member, and a plurality of male members having enlarged heads at one end, said male members disposed in said opeings with their enlarged heads in abutment with one of the flange members and the terminal portion, and female members for engaging with said male members, said female members cooperating with said male members to secure the flange members and terminal portions together.

23. The platform bed frame of claim 19 wherein the means for detachably securing each of said end plates to each said side plates to form a generally rectangular platform includes a plurality of identical coupling members for detachably securing said end plates to said side plates to form a generally rectangular platform, each of said coupling members comprising a generally planar central body portion having an upper edge, a lower edge, and side edges, a male portion extending generally upwardly of said central body portion from its upper edge, said male portion having an upper end and a lower end being tapered so that its upper end has a narrower width than its lower end, and a female portion having an upper end and a lower end for slidably receiving a tapered male portion from an adjacently disposed coupling member, said female portion integral with said central body portion and disposed adjacent a side edge of said central body portion in a substantially L-shaped arrangement therewith, the lower end of said female portion being substantially coextensive with the lower edge of said central body portion, said female portion being tapered so that its width is smaller at its lower end than at its upper end, said female portion including an inner section having a shape corresponding to the shape of the male portion, an intermediate section extending substantially inwardly of and transversely to said inner section, and an outer flange section extending generally inwardly of said intermediate section and toward said central body portion so that the female portion may slidingly interlock with the male portion of an adjacent coupling member, and wherein said coupling members are secured to said wall portions of said side plates and said intermediate portions of said end plates near each end thereof with each coupling member secured to each end of each of said end plates inversely oriented with respect to each complementarily disposed coupling member secured near each end of said side plates so that each joint comprises a pair of inversely oriented coupling members, with the male portion of each coupling member in said joint disposed in the female portion of each adjacent coupling member to thereby form a substantially L-shaped joint whereby said side plates and said end plates are mounted relatively rigidly in interlocking relationship with one another by forces applied to said support portions and upper arm portions by said mattress means and the reaction forces of said foot portions of said side plates and leg portions of side end plates against the floor upon which the platform is situated.

24. The platform bed frame of claim 19 wherein the means for detachably securing each of said end plates to each of said side plates to form a generally rectangular platform includes a plurality of paired coupling members, one of said pair of said coupling members comprising a female member, the female member including a central portion having an upper edge, a lower edge, and two side edges, said central portion narrower at its upper edge than at its lower edge, a side portion integral with one side edge of said central portion and extending generally transversely of said central portion, and a flange portion integral with the other side edge of said central portion and extending generally angularly thereof in substantially the same direction as said side portion, the other of said pair of said coupling members comprising a male member, said male member including a central portion having a top edge and a bottom edge and two side edges, the top edge of said male member narrower than the bottom edge, a side portion integral with one of the side edges of said central portion and extending generally transversely thereof, and a flange portion integral with the other side of the central portion and extending generally outwardly thereof in the same general direction as said side portion, said flange portion including a substantially planar portion extending angularly with respect to said central portion and in the same general direction as the side portion, an arcuate portion integral with the generally planar portion, and a terminal portion extending generally in the opposite direction as the generally planar portion to form a substantially V-shaped configuration, each end plate having one of said male and female coupling members secured thereto adjacent each end of its intermediate portion, and the other of said male and female coupling members secured to said side plate near each end of each wall portion in complementary relationship with the coupling members disposed on the intermediate portions of said end plates so that the male member is disposed in said female member in interlocking relation therewith to provide a joint between said side plate and said end plate whereby each said side plate and each said end plate are mounted relatively rigidly in interlocking relationship with one another by gravitional forces acting on said joint through said side plates and end plates.

25. A coupling member for detachably securing two adjacent members together, said coupling member comprising a generally planar central body portion having an upper edge, a lower edge, and side edges, said central body portion being capable of being secured to a member, a male portion extending generally upwardly of said central body portion from its upper edge, said male portion having an upper end and a lower end being tapered so that its upper end has a narrower width than its lower end, and a female portion having an upper end and a lower end for slidably receiving a tapered male portion from an adjacently disposed coupling member, said female portion integral with said central body portion and disposed adjacent a side edge of said central body portion in a substantially L-shaped arrangement therewith, the lower end of said female portion being substantially coextensive with the lower edge of said central body portion, said female portion being tapered so that its width is smaller at its lower end than at its upper end, said female portion including an inner section having a shape corresponding to the shape of the male portion, an intermediate section extending substantially inwardly of and transversely to said inner section, and an outer flange section extending generally inwardly of said intermediate section and toward said central body portion so that the female portion may slidingly interlock with the male portion of an adjacent coupling member, and wherein said two of said coupling members may be slidingly interlocked when said two coupling members are inversely oriented with respect to one another with the male portion of each coupling member disposed in the female portion of each adjacent coupling member to thereby form a substantially L-shaped joint.

26. The platform bed frame of claim 19 wherein said flange means is provided by a flange portion integral with said support portion.

27. A platform bed frame for use in supporting mattress means in spaced relationship to a floor comprising:

a pair of spaced parallel side plates, each side plate having substantially the same dimensions and including a wall portion having an upper edge and a lower edge and two ends and disposed generally vertically in relation to the floor, an upper horizontal member which is integral with the upper edge of the wall portion, and a lower horizontal member which is integral with the lower edge of the wall portion for confronting the surface upon which th platform is situated;

generally vertical flange means associated with said side plates and extending upwardly above the upper edge of the wall portion for preventing movement of said mattress means, a pair of longitudinally spaced end plates extending substantially transversely between said side plates, each end plate having substantially the same dimensions and including an intermediate portion having an upper edge and a lower edge and two ends and disposed generally vertically in relation to the floor, a generally horizontal upper arm portion which is integral with the upper edge of the intermediate portion, and a generally horizontal lower leg portion which is integral with the lower edge of the intermediate portion for confronting the surface upon which said platform is situated; and means for detachably securing each of said end plates to each of said side plates to form a generally rectangular platform.

28. The platform bed frame of claim 27 wherein the upper horizontal member is disposed generally transversely of and extending outwardly of the wall portion.

29. The platform bed frame of claim 27 wherein the upper horizontal member and the generally horizontal upper arm portion provide upright support for said mattress means.

30. The platform bed frame of claim 27 wherein said vertical flange means is integral with said upper horizontal member.

* * * * *

UNITED STATES PATENT AND TRADEMARK OFFICE

CERTIFICATE OF CORRECTION

PATENT NO. : 4,155,131

DATED : May 22, 1979

INVENTOR(S) : Allan E. Harris and George M. Harris

It is certified that error appears in the above-identified patent and that said Letters Patent are hereby corrected as shown below:

Column 6, line 15, "diposed" should be --disposed--;

Column 7, line 16, "37a" should be --37--;

Column 15, line 51/52, "said portion" should be --"said wall portion"--;

Column 16, line 59, "said plates" should be --said end plates--;

Column 17, line 43, "said plates" should be --said end plates--;

Column 18, line 60, "inincluding" should be --including--;

Column 22, line 36, "which th" should be --which the--;

Column 22, line 40, insert --lateral-- after "preventing".

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*